US008627527B2

(12) United States Patent
Lee et al.

(10) Patent No.: US 8,627,527 B2
(45) **Date of Patent: *Jan. 14, 2014**

(54) LAUNDRY TREATING DEVICE AND METHOD OF CONTROLLING THE SAME

(71) Applicants: Dong Soo Lee, Seoul (KR); Ki Chul Woo, Seoul (KR); Na Eun Kim, Seoul (KR); Dong Won Kim, Seoul (KR); Sung Min Kim, Seoul (KR); Sung Ryong Kim, Seoul (KR)

(72) Inventors: Dong Soo Lee, Seoul (KR); Ki Chul Woo, Seoul (KR); Na Eun Kim, Seoul (KR); Dong Won Kim, Seoul (KR); Sung Min Kim, Seoul (KR); Sung Ryong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/759,119

(22) Filed: Feb. 5, 2013

(65) Prior Publication Data

US 2013/0145564 A1 Jun. 13, 2013

Related U.S. Application Data

(63) Continuation of application No. 12/253,016, filed on Oct. 16, 2008.

(30) Foreign Application Priority Data

Nov. 27, 2007 (KR) ..... 10-2007-0121644

(51) Int. Cl.
*D06F 35/00* (2006.01)

(52) U.S. Cl.
USPC ..... 8/158; 8/159

(58) Field of Classification Search
USPC ..... 8/158–159
See application file for complete search history.

(56) References Cited

U.S. PATENT DOCUMENTS

| | | | |
|---|---|---|---|
| 3,231,909 | A | 2/1966 | Candor |
| 7,735,344 | B2 | 6/2010 | Omura et al. |

FOREIGN PATENT DOCUMENTS

| | | | |
|---|---|---|---|
| AU | 2007342790 | | 7/2008 |
| CN | 2755141 | Y | 2/2006 |
| DE | 2 100 343 | | 7/1971 |
| DE | 195 22 438 | | 1/1997 |
| EP | 0 688 894 | | 12/1995 |
| EP | 1 882 768 | | 1/2008 |
| JP | 61-259690 | | 11/1986 |
| JP | 03-021294 | | 6/1989 |
| JP | 2-128792 | | 5/1990 |
| JP | 03-021295 | | 1/1991 |
| JP | 10-15276 | | 1/1998 |
| JP | 10-85478 | | 4/1998 |
| KR | 10-2004-0006279 | | 1/2004 |
| KR | 10-2004-0006683 | | 1/2004 |
| KR | 10-2006-0045727 | | 5/2006 |
| RU | 2 293 806 | | 2/2007 |

(Continued)

OTHER PUBLICATIONS

European Search Report dated Mar. 10, 2009.

(Continued)

*Primary Examiner* — Jason Ko
(74) *Attorney, Agent, or Firm* — KED & Associates, LLP

(57) ABSTRACT

A laundry treating device includes two separate laundry washing mechanisms. Methods of controlling such a laundry treating device include steps for supplying water to a first tub provided in the first laundry treating device and to a second tub provided in the second laundry treating device. The water can be supplied to the two tubs simultaneously or separately. Also, the water supply steps can be alternated. Further individual hot and cold water supply steps can include simultaneously or sequentially supplying the hot and cold water.

15 Claims, 6 Drawing Sheets

(56) References Cited

FOREIGN PATENT DOCUMENTS

| | | |
|---|---|---|
| UA | 65749 | 4/2004 |
| UA | 10648 | 11/2005 |
| WO | WO 02/12609 | 2/2002 |
| WO | WO 2008/069607 | 6/2008 |

OTHER PUBLICATIONS

European Office Action issued in EP Application No. 08151271.7 dated Jun. 16, 2010.
International Search Report and Written Opinion issued in PCT Appln No. PCT/KR2008/006748 dated Sep. 14, 2010.
Russian Notice of Allowance issued in Russian Appln No. 2010126227 dated Jan. 21, 2011.
Ukrainian Notice of Allowance issued in Application No. 2008330398 dated Feb. 14, 2011.
Australian Office Action issued in AU Application No. 2008330398 dated Apr. 20, 2011.
Chinese Office Action issued in Chinese Appln. No. 200880116765 dated Dec. 15, 2011.
Non-Final Office Action issued in U.S. Appl. No. 12/253,016 dated Aug. 9, 2011.
Okano et al., Jun. 1989, JP 03-021294, English machine translation of abstract.
Final Office Action issued in U.S. Appl. No. 12/253,016 dated Feb. 10, 2012.
Non-Final Office Action issued in U.S. Appl. No. 12/253,016 dated Jul. 16, 2012.
Final Office Action issued in U.S. Appl. No. 12/253,016 dated Oct. 31, 2012.
U.S. Office Action issued in U.S. Appl. No. 12/253,016 dated Feb. 15, 2013.
Australian Office Action issued in Australian Application No. 2012227170 dated Sep. 9, 2013.

FIG. 3

| Operation Mode (X) | Operation Order |
|---|---|
| $X_1$ | Mif → Sif |
| $X_2$ | Mi → Sif → Mf |
| $X_3$ | Mi → Si → Mf→ Sf |
| $X_4$ | Mi → Si→M→Sf → Mf |
| $X_5$ | Mi → Si. Mf→ Sf |
| $X_6$ | Mi → Si→Mf.Sf |
| $X_7$ | Mi → Sif.Mf |
| $X_8$ | Sif → Mif |
| $X_9$ | Si →Mif → Sf |
| $X_{10}$ | Si→Mi→Sf→Mf |
| $X_{11}$ | Si→Mi→S→Mf→Sf |
| $X_{12}$ | Si→Mi.Sf→Mf |
| $X_{13}$ | Si→Mi→Mf.Sf |
| $X_{14}$ | Si→Mif.Sf |
| $X_{15}$ | Mi.Si→Mf.Sf |
| $X_{16}$ | Mi.Si→M.Sf→Mf |
| $X_{17}$ | Mi.Si→ Mf.S→Sf |

FIG. 4

| Operation Mode (Y) | | Operation Order |
|---|---|---|
| $Y_1$ | Mi | Ms → Sif→Mf |
| $Y_2$ | Mi | Ms→Si→M→Sf→Mf |
| $Y_3$ | Mi | Ms→Si→Mf→Sf |
| $Y_4$ | Mi | Mf→Sif |
| $Y_5$ | Mi | M → Sif→ Mf |
| $Y_6$ | Mi | M → Si→Mf→Sf |
| $Y_7$ | Mi | M → Si→M→Sf→Mf |
| $Y_8$ | Mi | M.Si → Mf.Sf |
| $Y_9$ | Mi | M.Si →M.Sf→Mf |
| $Y_{10}$ | Mi | M.Si→Mf.S→Sf |
| $Y_{11}$ | Si | Ss→Mif→ Sf |
| $Y_{12}$ | Si | Ss→Mi→S→ Mf→Sf |
| $Y_{13}$ | Si | Ss→Mi→Sf→Mf |
| $Y_{14}$ | Si | Sf→Mif |
| $Y_{15}$ | Si | S→Mif→ Sf |
| $Y_{16}$ | Si | S→Mi→Sf→Mf |
| $Y_{17}$ | Si | S→Mi→S→ Mf→Sf |
| $Y_{18}$ | Si | S.Mi→Sf.Mf |
| $Y_{19}$ | Si | S.Mi→S.Mf→Sf |
| $Y_{20}$ | Si | S.Mi→Sf.M→Mf |

FIG. 5

| Operation Mode (Z) | Operation Order |
|---|---|
| $Z_1$ | Hif → Cif |
| $Z_2$ | Hi → Cif→Hf |
| $Z_3$ | Hi → Ci→Hf→Cf |
| $Z_4$ | Hi → Ci→H→Cf→Hf |
| $Z_5$ | Hi→Ci.Hf→Cf |
| $Z_6$ | Hi→Ci→Hf.Cf |
| $Z_7$ | Hi→Cif.Hf |
| $Z_8$ | Cif→Hif |
| $Z_9$ | Ci→Hif→Cf |
| $Z_{10}$ | Ci→Hi→Cf→Hf |
| $Z_{11}$ | Ci→Hi→C→Hf→Cf |
| $Z_{12}$ | Ci→Hi.Cf→Hf |
| $Z_{13}$ | Ci→Hi→Hf.Cf |
| $Z_{14}$ | Ci→Hif.Cf |
| $Z_{15}$ | Hi.Ci→Hf.Cf |
| $Z_{16}$ | Hi.Ci→H.Cf→Hf |
| $Z_{17}$ | Hi.Ci→Hf.C→Cf |

LAUNDRY TREATING DEVICE AND METHOD OF CONTROLLING THE SAME

CROSS-REFERENCE TO RELATED APPLICATION(S)

This application is a continuation of U.S. patent application Ser. No. 12/253,016 filed on Oct. 16, 2008, which claims the benefit of Korean Patent Application No. 10-2007-0121644, filed in Korea on Nov. 27, 2007, which is hereby incorporated in its entirety by reference as if fully set forth herein.

BACKGROUND

1. Field

The present disclosure relates to a laundry treating device capable of washing or drying laundry, and a method of controlling the same.

2. Background

A washing machine, which is a representative laundry treating device, performs washing, rinsing, and spin-drying operations, in order to remove contaminants attached to laundry using the interaction of detergent and water. A drying machine, which is another representative laundry treating device, is a home appliance for drying wet clothes, etc. Recently, a home appliance having a combined function of a washing machine and a drying machine has widely been used.

Generally, such laundry treating devices are classified into a top loading type and a front loading type based on the laundry loading position. Typically, a laundry treating device is directly installed on a wood, cement, or tile floor. In this connection, in the case of a front loading type laundry treating device, it is inconvenient for the user to load and unload laundry because the position of the loading/unloading opening of the device is low.

Generally, only one large-capacity washing machine is installed in a home. When one desires to wash different kinds of laundry in different loads, it is necessary to operate the washing machine several times. For example, when one desires to wash adult clothes and underclothes or baby clothes in two separate loads, the washing machine operates two tunes to individually wash the two different kinds of laundry. For this reason, the washing time increases, and the consumption of energy also increases.

Furthermore, it is undesirable to use a large-capacity washing machine to wash a small amount of laundry, in terms of saving of energy and water. This is because the washing course set in the large-capacity washing machine is typical for larger loads, and as a result, the amount of water consumed in the washing course is large. Also, a large amount of electricity is consumed because it is necessary to rotate a large-size drum or pulsator.

Also, in most laundry machines, the washing course set in a large-capacity washing machine is typical for general clothes. For this reason, the large-capacity washing machine may be unsuitable for the washing of delicate clothes such as underclothes or baby clothes. For similar reasons, a large-capacity washing machine is unsuitable where small amounts of laundry are frequently washed. Generally, users collect laundry for several days, in order to wash the collected laundry at one time. However, leaving laundry, in particular, underclothes or baby clothes, without immediately washing them, is undesirable in terms of cleanliness. Furthermore, when such clothes are left for a long period of time, there is a problem in that they cannot be washed as well because dirt may become fixed to the clothes.

For all the above reasons it is often desirable to use a small-size washing machine having a capacity much smaller than the conventional large-capacity washing machine. However, where two small-size washing machines are provided in a home, there are problems associated with space utility and beauty, even though the size of the washing machines is small.

BRIEF DESCRIPTION OF THE DRAWINGS

The embodiments will be described in detail with reference to the following drawings, in which like reference numerals refer to like elements, and wherein:

FIG. 3 is a table illustrating methods of controlling the laundry treating device;

FIG. 4 is a table illustrating additional methods of controlling the laundry treating device;

FIG. 5 is a table illustrating methods for supplying cold water and hot water to the laundry treating device.

DETAILED DESCRIPTION

Figure 1:
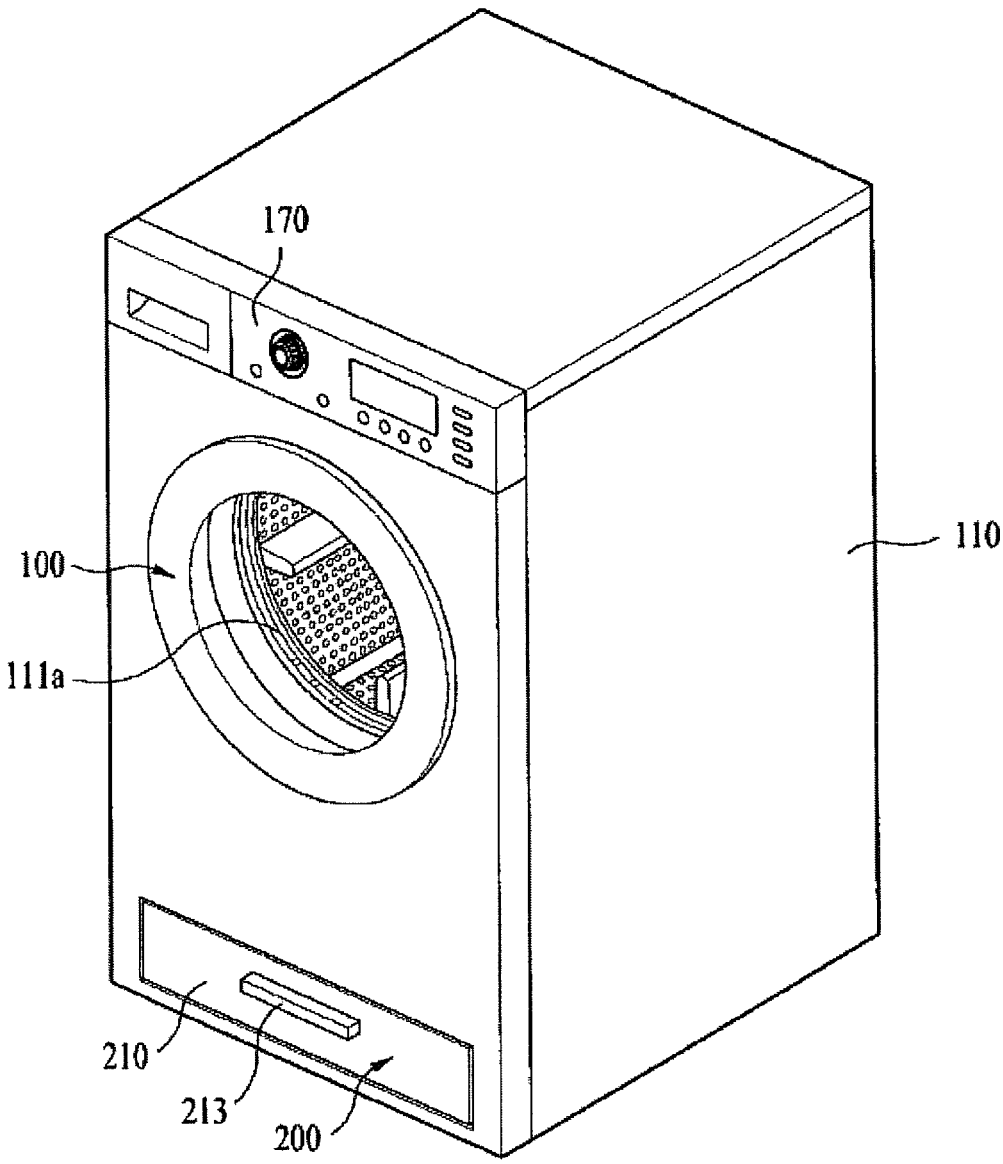
FIG. 1 is a perspective view illustrating a first embodiment of a laundry treating device.
Figure 2:
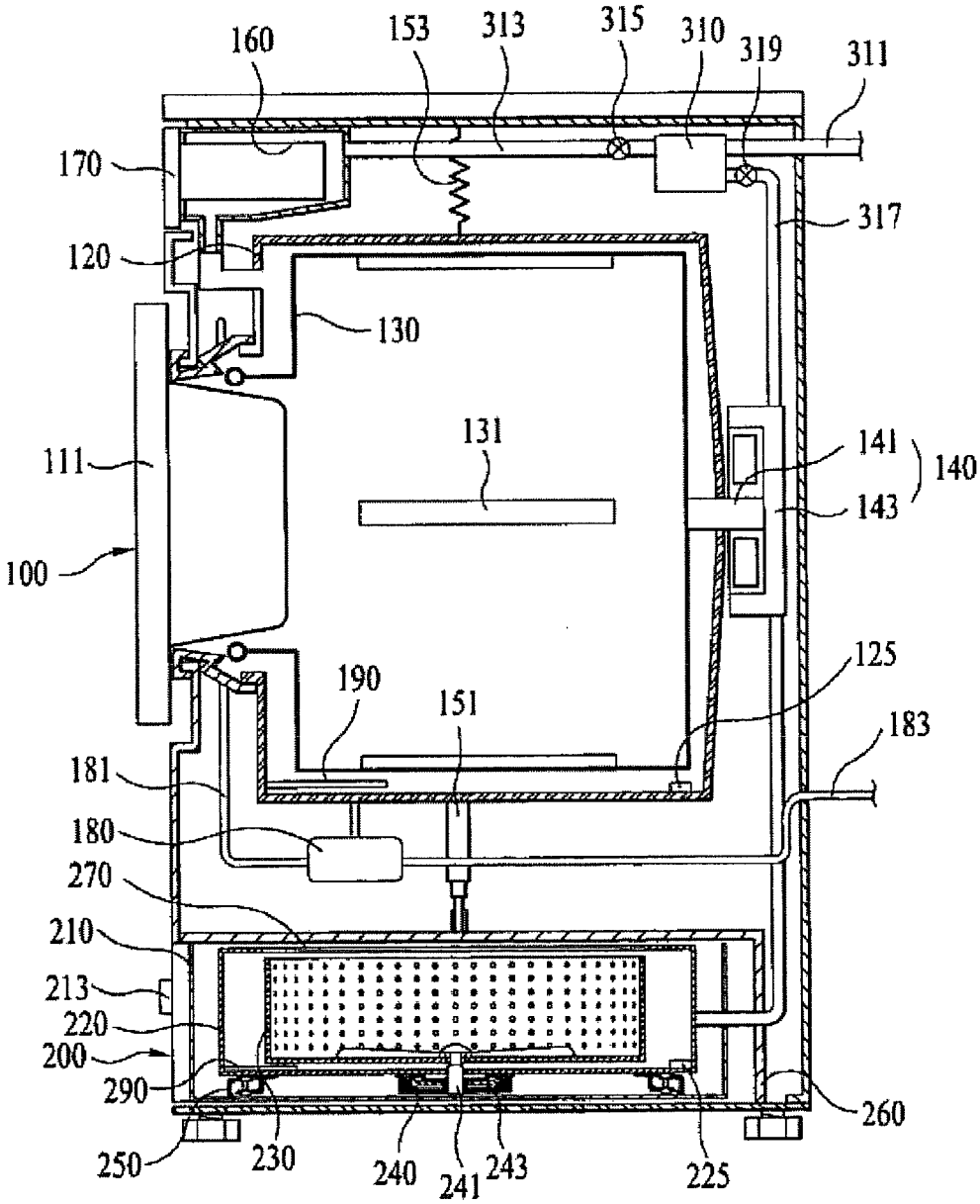
FIG. 2 is a side sectional view of the laundry treating device.

Reference will now be made in detail to preferred embodiments, examples of which are illustrated in the accompanying drawings. An exemplary embodiment of a laundry treating device will first be described with reference to FIGS. 1 and 2.

The laundry treating device includes a cabinet 110 constituting an outer structure of the laundry treating device, a first laundry treating device 100 installed in the cabinet 110, and a second laundry treating device 200 is also installed in the cabinet 110 in the vicinity of the first laundry treating device 100. The second laundry treating device 200 can operate independently of the first laundry treating device 100.

A control panel 170 is arranged at the front side of the cabinet 110, to control the first and second laundry treating devices. At the front side of the cabinet 110, a first door 111 opens into the first laundry treating device 100. A front wall of a case 210 included in the second laundry treating device 200 is located below the door 111.

The first laundry treating device 100 includes a first washing tub 120, a first drum 130 rotatably installed in the first washing tub 120, and a first driver 140 to drive the first drum 130. The first door 111, which is also included in the first laundry treating device 100, functions to open or close the first drum 130. The top of the first washing tub 120 is connected to the cabinet 110 by a suspension member 153. The bottom of the first washing tub 120 is connected to a housing 260 by a first damper 151. Of course, the first washing tub 120 may be formed integrally with the cabinet 110.

The central rotating axis of the first drum 130 is parallel with the floor on which the laundry treating device is installed. The first drum 130 has an opening 111*a* open toward the front side of the cabinet 110. A plurality of lifts, which operate to agitate and wash laundry, are arranged on an inner surface of the first drum 130. The lifts 131 raise laundry contained in the first drum 130, and then let the raised laundry fall, to cause frictional forces and impact forces to be applied to the laundry.

The first driver 140 includes a first drive shaft 141 connected to the first drum 130, and a first motor 143 to rotate the first drive shaft 141. The first driver 140 supports the first washing tub 120 at the rear side of the first washing tub 120, while rotating the first drum 130.

The first door 111 is hinged to the cabinet 110 at the front side of the cabinet 110. The central portion of the first door 111 is configured to allow the user to view the interior of the first drum 130.

The second laundry treating device 200 includes, in addition to the case 210, a second washing tub 220 installed in the case 210. A second drum 230 is rotatably installed in the second washing tub 220, and a second driver 240 drives the second drum 230. A second door 270 opens or closes the second drum 230.

The second laundry treating device 200 is received in the mover housing 260, which is arranged beneath the first laundry treating device 100. The second laundry treating device 200 is movable in forward/rearward directions so that it can be slid out or pushed back into the cabinet. A handle 213 is provided at the front side of the second laundry treating device 200 to allow the user to move the second laundry treating device 200 into and out of the cabinet. The case 210 can slide along the mover housing 260. The second washing tub 220 is received in the case 210. The second washing tub 220 is coupled to the bottom of the case 210 inside the case 210 by a second damper 250.

The central rotating axis of the second drum 230 is perpendicular to the floor. The second drum 230 has an opening (not shown) foamed through the top of the second drum 230. Accordingly, a second door 270 is installed at the top of the second drum 230. Thus, the second laundry treating device 200 is of a top loading type.

The second driver 240 includes a second drive shaft 241 connected to the second drum 230, and a second motor 243 to rotate the second drive shaft 241. The second driver 240 supports the second washing tub 220 at the bottom of the second washing tub 220, while rotating the second drum 230.

The laundry treating device further includes a water supply unit to supply water to the first and second washing tubs 120 and 220. The water supply unit may include both a hot water supplier to supply hot water, and a cold water supplier to supply cold water. In alternative embodiments, only a cold water supplier may be provided. In this instance, heaters may also be provided in the first and second tubs.

The hot water supplier may include a hot water tank 310 to store water, and a heater (not shown) to heat the water stored in the hot water tank 310. A first hot water pipe 313 guides hot water from the hot water tank 310 to the first washing tub 120, and a second hot water pipe 317 to guide the hot water from the hot water tank 310 to the second washing tub 220. The hot water supplier may also include a first hot water control valve 315 arranged in the first hot water pipe 313, to control the amount of hot water supplied to the first washing tub 120, and a second hot water control valve 319 arranged in the second hot water pipe 317, to control the amount of hot water supplied to the second washing tub 220.

The first hot water pipe 313 may be connected, at one end thereof, to the hot water tank 310, and may be connected, at the other end thereof, to a first detergent box 160. As a result, hot water which is guided through the first hot water pipe 313 is supplied to the first washing tub 120 after passing through the first detergent box 160. Similarly, the second hot water pipe 317 may be connected, at one end thereof, to the hot water tank 310, and may be connected, at the other end thereof, to a second detergent box (not shown). As a result, hot water, which is guided through the second hot water pipe 317 is supplied to the second washing tub 220 after passing through the second detergent box.

Alternatively, a single detergent box may be installed. In this case, a single pipe from the hot water tank 310 would be connected to the single detergent box. The first hot water pipe 313 and the second hot water pipe 317 would then be connected, at one end thereof, to the single detergent box. Accordingly, when water is to be supplied to the first washing tub 120, or when water is to be supplied to the second washing tub 220, hot water from the hot water tank 310 always passes through the detergent box.

The cold water supply may include a first cold water pipe 333 to guide cold water to the first washing tub 120, and a second cold water pipe 337 to guide cold water to the second washing tub 220. Of course, the cold water supply may further include a cold water tank 330 to temporarily store cold water.

The cold water supply may also include a cold water control valve 335 arranged at a branching point of the first and second cold water pipes 333 and 337, to control the amount of cold water supplied to the first and second washing tubs 120 and 220. Of course, separate cold water control valves may be installed in the respective cold water supply pipes, similar to the hot water control valves. Also, the first and second cold water pipes 333 and 337 may be connected to one or more detergent boxes such that when cold water is supplied to the first washing tub 120 or second washing tub 220, a detergent is introduced into the first washing tub 120 or second washing tub 220, together with the cold water.

One end of each line connected to the water tank(s) may be arranged at a level higher than the other end of the line connected to the first and second washing tubs. In this case, water emerging from the water tank(s) can be naturally introduced into the first and second washing tubs in accordance with the water head difference between the opposite ends of the line, without using a pump.

A first temperature sensor 125 may be arranged in the first washing tub 120 to measure the temperature of water in the first washing tub 120. A second temperature sensor 225 may be arranged in the second washing tub 220 to measure the temperature of water in the second washing tub 220.

Meanwhile, a first draining pipe 183 and a first circulating pipe 181 are arranged in the cabinet 110. The first draining pipe 183 functions to outwardly drain water from the first washing tub 120. The first circulating pipe 181 functions to reintroduce water that has been discharged from the first washing tub 120 back into the first washing tub 120.

A first circulating pump 180 is arranged at a branching point of the first draining pipe 183 and first circulating pipe 181, to outwardly drain or circulate water emerging from the first washing tub 120. The water emerging from the first washing tub 120 can be pumped to spray the pumped water back into the first washing tub 120. In accordance with the pumping and spraying operation, diverse water flows are generated in the first drum 130, and impact force and frictional force are generated through the water spray. Accordingly, it is possible to achieve an enhancement in washing and rinsing efficiencies.

Similarly, a second draining pipe (not shown) and a second circulating pipe (not shown) are arranged in the cabinet 110. The second draining pipe functions to outwardly drain water from the second washing tub 220. The second circulating pipe functions to reintroduce water discharged from the second washing tub 220 back into the second washing tub 220. A second circulating pump (not shown) may also be installed at a branching point of the second draining pipe and second circulating pipe.

Hereinafter, a procedure for supplying water to the washing tubs of the first and second laundry treating devices when the first and second laundry treating devices operate simultaneously will be described with reference to FIG. 3.

The first and second laundry treating devices may simultaneously operate to wash laundry contained therein. In this case, the user inputs a command to operate the first and second laundry treating devices. The command may be input to a controller, which controls the first and second laundry treating devices, before water is supplied to the first and second laundry treating devices. In response to the command, the controller selectively or simultaneously causes water to be supplied to the first washing tub 120 included in the first laundry treating device 100 and the second washing tub 220 included in the second laundry treating device 200.

When a first water supply step for supplying water to the first washing tub 120 and a second water supply step for supplying water to the second washing tub 220 are selectively executed, the priority order of the first and second water supply steps may be determined in accordance with a predetermined control algorithm. The control algorithm may be implemented in various forms. For example, the controller may determine a water supply order based on heat amounts of water to be respectively supplied to the first and second washing tubs 120 and 220. Alternatively, the controller may determine the water supply order in accordance with a user's command. Otherwise, there may be a water supply order previously stored in the controller.

Each operation mode X shown in FIG. 3 represents a different order of operations to supply water to the respective washing tubs 120 and 220 when the first and second laundry treating devices 100 and 200 are to operate simultaneously. In FIG. 3, "M" represents the supply of water to the first laundry treating device 100, whereas "S" represents the supply of water to the second laundry treating device 200. "$M_{if}$" represents the step of initiating the supply of water to the first laundry treating device, and continuing the water supply until the water supply to the first laundry treating device is finished. "$M_i$" represents the step of initiating the supply of water to the first laundry treating device, but then stopping before all the required water is supplied to the first laundry treating device. "$M_f$" represents the step of resuming the supply of water to the first laundry treating device (assuming it has been previously interrupted) until all the required water is supplied, thereby finishing the water supply to the first laundry treating device.

Similarly, "$S_{if}$", "$S_i$", and "$S_f$" represent the step of initiating the supply of water to the second laundry treating device and continuing the water supply until the water supply to the second laundry treating device is finished, the step of initiating the supply of water to the second laundry treating device but then stopping before it is completed, and the step of resuming the supply of washing water to the second laundry treating device until it is finished, respectively.

The operation mode X1 represents the procedure of initiating the water supply to the first washing tub of the first laundry treating device, and continuing the water supply until the water supply to the first washing tub is finished (Mit), and then initiating the supply of water to the second washing tub of the second laundry treating device, and continuing the water supply until the water supply to the second washing tub is finished ($S_{if}$).

The operation mode X2 represents the procedure of initiating the water supply to the first washing tub ($M_i$), then halting the supply of water to the first washing tub and initiating the supply of water to the second washing tub. Water is continuously supplied until the water supply to the second washing tub is finished ($S_{if}$). Finally water supply to the first tub is resumed until the supply of water to the first washing tub is finished ($M_f$).

The operation mode X3 represents the procedure of initiating the water supply to the first washing tub ($M_i$), then halting the supply of water to the first washing tub. Next, the supply of water to the second washing tub is initiated, but it is also stopped before it can be finished ($S_i$). Next, water is again supplied to the first washing tub until the water supply to the first tub is finished ($M_f$). Finally, water is again supplied to the second washing tub to finish the water supply to the second washing tub ($S_f$).

The operation mode X4 represents the procedure of initiating the water supply to the first washing tub ($M_i$), halting the supply of water to the first tub and initiating the supply of water to the second washing tub ($S_i$), halting the supply of water to the second tub and again supplying water to the first washing tub for a predetermined time (M), halting the supply of water to the first tub and again supplying water to the second washing tub until the water supply to the second washing tub is finished ($S_f$), and then again supplying water to the first washing tub until the water supply to the first washing tub is finished ($M_f$).

The operation mode X5 represents the procedure of initiating the water supply to the first washing tub ($M_i$), then also supplying water to the second tub to simultaneously supply water to the first and second washing tubs to preferentially finish the water supply to the first washing tub ($S_i \cdot M_f$), and then subsequently finishing the water supply to the second washing tub ($S_f$).

The operation mode X6 represents the procedure of initiating the water supply to the first washing tub ($M_i$), halting supply of water to the first tub and initiating the supply of water to the second washing tub ($S_i$), then simultaneously supplying water to both the first and second washing tubs, to finish the water supply to the first and second washing tubs ($M_f \cdot S_f$).

The operation mode X7 represents the procedure of initiating the water supply to the first washing tub ($M_i$), and then initiating the supply of water to the second washing tub after a predetermined time elapses, such that water is simultaneously supplied to the first and second washing tubs, to finish the water supply to the first and second washing tubs ($S_{if} \cdot M_f$).

Meanwhile, the operation modes X8, X9, X10, X11, X12, X13, and X14 are similar to the operation modes X1, X2, X3, X4, X5, X6, and X7, respectively. However, they are reverse to each other in terms of the order of water supply to the first and second washing tubs.

For example, the operation mode X8 represents the procedure of initiating the water supply to the second washing tub and continuing the water supply until the water supply to the second washing tub is finished ($S_{if}$), then initiating the supply of water to the first washing tub of the first laundry treating device, and continuing the water supply until the water supply to the first washing tub is finished ($M_{if}$). The description of the operation modes X9, X10, X11, X12, X13, and X14 will be omitted.

Meanwhile, each of the operation modes X15, X16, and X17 represent the procedure of simultaneously supplying water to the first washing tub of the first laundry treating device and the second washing tub of the second laundry treating device from the beginning of the water supply operation. The operation mode X15 represents the procedure of simultaneously initiating the water supply to the first and second washing tubs ($M_i \cdot S_i$), and simultaneously finishing the water supply to the first and second washing tubs ($M_f \cdot S_f$).

When the amounts of water required in the first and second washing tubs are different from each other in this case, it is possible to simultaneously finish the water supply to the first and second washing tubs by adjusting the flow rates of the water supplied to either or both of the first and second washing tubs.

The operation mode X16 represents the procedure of simultaneously initiating the water supply to the first and second washing tubs preferentially finishing the water supply to the second washing tub while continuing to supply water to the first tub ($M \cdot S_f$), and subsequently finishing the water supply to the first washing tub ($M_f$).

The operation mode X17 represents the procedure of simultaneously initiating the water supply to the first and second washing tubs ($M_i \cdot S_i$), preferentially finishing the water supply to the first washing tub while continuing to supply water to the second tub ($M_f \cdot S$), and then subsequently finishing the water supply to the second washing tub ($S_f$).

Thus, as in the operation mode X1 or X8, the first and second water supply steps may be executed such that one step is executed after the finish of the other step. Also, as in the operation mode X4 or X11, the first and second water supply steps may be executed such that they are alternately executed until the amount of water in one of the first and second washing tubs reaches a predetermined water amount. Of course, the time during which water is supplied to the first washing tub, and the time during which water is supplied to the second washing tub, may be set to different values.

Also, as in the operation mode X5, X6, X11, or X12, water may be supplied to one washing tub during the water supply to the other washing tub.

Each of the first and second water supply steps may include a hot water supply step and a cold water supply step. The operation mode for the water supply at the hot water supply step and cold water supply step will be described later.

Hereinafter, methods will be described for situations where water is already being supplied to one of the first and second washing tubs, and where the user then instructs the other of the first and second laundry treating devices to start to operate. In response to the user's command to start the other laundry treating device, the controller may stop or continue the water supply to the laundry treating device which was already in operation.

The water supply to the laundry treating devices may be determined in accordance with a predetermined control algorithm. The control algorithm may be implemented in various forms. For example, the controller may determine a water supply order based on amounts of water or heat amounts of water to be respectively supplied to the first and second washing tubs 120 and 220. Alternatively, the controller may determine the water supply order in accordance with a user's command. Otherwise, there may be a water supply order previously stored in the controller.

In FIG. 4, each of the operation modes Y1 to Y10 represents an operation mode wherein the first laundry treating device is already in operation, and wherein the user instructs the second laundry treating device to start to operate. On the other hand, each of the operation modes Y11 to Y20 represents an operation mode wherein the first laundry treating device starts to operate while the second laundry treating device is already in operation.

Each of the operation modes Y1 to Y3 represents an operation mode wherein when the second laundry treating device starts to operate during the operation of the first laundry treating device, the water supply to the first washing tub of the first laundry treating device is stopped, and water is supplied to the second laundry treating device.

Each of the operation modes Y4 to Y7 represents an operation mode wherein when the second laundry treating device starts to operate during the operation of the first laundry treating device, the water supply to the first washing tub of the first laundry treating device is continued, and water is supplied to the second laundry treating device after a predetermined time elapses.

In addition, each of the operation modes Y8 to Y10 represents an operation mode wherein when the second laundry treating device starts to operate during the operation of the first laundry treating device, water is simultaneously supplied to both the first and second laundry treating devices.

In detail, in the operation mode Y1, when the second laundry treating device starts to operate during the water supply to the first laundry treating device ($M_i$), the water supply to the first washing tub of the first laundry treating device is temporarily stopped ($M_s$). Here, the subscript "s" represents the temporary stop of the water supply. Thereafter, the water supply to the second washing tub of the second laundry treating device is initiated and continues until it is finished ($S_{if}$). After the finish of the water supply to the second washing tub, water is again supplied to the first washing tub, to finish the water supply to the first washing tub ($M_f$).

In the operation mode Y2, when the second laundry treating device starts to operate during the water supply to the first laundry treating device ($M_i$), the water supply to the first washing tub of the first laundry treating device is temporarily stopped ($M_s$). Thereafter, the water supply to the second washing tub of the second laundry treating device is initiated ($S_i$). After a predetermined time elapses, the water supply to the second washing tub is stopped, and water is again supplied to the first washing tub for a predetermined time, and it is then stopped (M). Thereafter, water is again supplied to the second washing tub, to finish the water supply to the second washing tub ($S_f$). Subsequently, water is again supplied to the first washing tub, to finish the water supply to the first washing tub ($M_f$).

In the operation mode Y3, when the second laundry treating device starts to operate during the water supply to the first laundry treating device ($M_i$), the water supply to the first washing tub of the first laundry treating device is temporarily stopped ($M_s$). Thereafter, the water supply to the second washing tub of the second laundry treating device is initiated ($S_i$). After a predetermined time elapses, the water supply to the second washing tub is stopped, and water is again supplied to the first washing tub, to finish the water supply to the first washing tub ($M_f$). Thereafter, water is again supplied to the second washing tub, to finish the water supply to the second washing tub ($S_f$).

In the operation mode Y4, when the second laundry treating device starts to operate during the water supply to the first laundry treating device ($M_i$), the water supply to the second washing tub of the second laundry treating device is not initiated until the water supply to the first laundry treating device is finished ($M_f$). After the finish of the water supply to the first laundry treating device, the water supply to the second laundry treating device is initiated, and it continues until the supply to the second laundry treating device is finished ($S_{if}$).

In the operation mode Y5, when the second laundry treating device starts to operate during the water supply to the first laundry treating device ($M_i$), the water supply to the first laundry treating device is continued for a predetermined time, and is then stopped (M). Thereafter, the water supply to the second washing tub of the second laundry treating device is initiated and finished ($S_{if}$). Subsequently, water is again supplied to the first laundry treating device, to finish the water supply to the first laundry treating device ($M_f$).

In the operation mode Y6, when the second laundry treating device starts to operate during the water supply to the first laundry treating device ($M_i$), the water supply to the first laundry treating device is continued for a predetermined time, and is then stopped (M). Thereafter, the water supply to the second washing tub of the second laundry treating device is initiated ($S_i$). After a predetermined time elapses, the water supply to the second washing tub is stopped, and water is again supplied to the first laundry treating device, to finish the water supply to the first laundry treating device ($M_f$). Thereafter, water is again supplied to the second washing tub, to finish the water supply to the second laundry treating device ($S_f$).

In the operation mode Y7, when the second laundry treating device starts to operate during the water supply to the first laundry treating device ($M_i$), the water supply to the first laundry treating device is continued for a predetermined time, and is then stopped (M). Thereafter, the water supply to the second washing tub of the second laundry treating device is initiated ($S_i$). After a predetermined time elapses, the water supply to the second washing tub is stopped, and water is again supplied to the first laundry treating device for a predetermined time and is then stopped (M). Thereafter, water is again supplied to the second washing tub, to finish the water supply to the second laundry treating device ($S_f$). Subsequently, water is again supplied to the first washing tub, to finish the water supply to the first laundry treating device ($M_f$).

In the operation mode Y8, when the second laundry treating device starts to operate during the water supply to the first laundry treating device ($M_i$), water is supplied to the second laundry treating device simultaneously with water being supplied to the first laundry treating device ($M\ S_i$). Thereafter, the water supply to the first laundry treating device and the water supply to the second laundry treating device are simultaneously finished ($M_f \cdot S_f$).

In the operation mode Y9, when the second laundry treating device starts to operate during the water supply to the first laundry treating device ($M_i$), water is supplied simultaneously to both the first and second laundry treating devices ($M\ S_i$). Thereafter, the water supply to the second laundry treating device is preferentially finished ($M \cdot S_f$). Subsequently, the water supply to the first laundry treating device continues until the water supply to the first laundry treating device is finished ($M_f$).

In the operation mode Y10, when the second laundry treating device starts to operate during the water supply to the first laundry treating device ($M_i$), water is simultaneously supplied to both the first and the second laundry treating device ($M\ S_i$). Thereafter, the water supply to the first laundry treating device is preferentially finished ($M_f \cdot S$) while the supply to the second laundry treating device continues. Subsequently, the water supply to the second laundry treating device is finished ($S_f$).

The operation modes Y11 to Y20 are similar to the operation modes Y1 to Y10, respectively. However, they are reverse to each other in terms of the order of water supply to the first and second washing tubs, namely, the order of M and S.

As in the operation modes Y1 to Y3, in the operation modes Y11 to Y13, the water supply procedure may include an intermediate water supply step for supplying water to the laundry treating device that starts to operate while the other device is already in operation. The intermediate water supply step may be step $S_{if}$ in the operation mode Y1, and step $S_i$ in the operation mode Y2 or Y3. Also, the intermediate water supply step may be step $M_{if}$ in the operation mode Y11, and step $M_i$ in the operation mode Y12 or Y13. Also, the water supply procedure may include an additional water supply step for again supplying water to the laundry treating device that was originally operating after the finish of the intermediate water supply step. Here, the additional water supply step may be step $M_f$ in the operation mode Y1, step M in the operation mode Y2, and step $M_f$ in the operation mode Y3. Also, the additional water supply step may be step $S_f$ in the operation mode Y11, step S in the operation mode Y12, and step $S_f$ in the operation mode Y13.

Also in the operation modes Y2 or Y3 and the operation modes Y12 or Y13, the intermediate water supply step and the additional water supply step may be alternately executed until one of the washing tubs reaches a predetermined water amount.

In the operation modes Y4 to Y7 and the operation modes Y14 to Y17, the water supply procedure may include a continuous water supply step for continuously supplying water to the washing tub included in the other laundry treating device which was already in operation, and an intermediate water supply step for supplying water to the washing tub included in the laundry treating device which starts to operate during the operation of the other laundry treating device. Here, the continuous water supply step may be step $M_f$ in the operation mode Y4, and step M in each of the operation modes Y5 to Y7. The intermediate water supply step may be step $S_{if}$ in the operation mode Y4 or Y5, and step $S_i$ in the operation mode Y6 or Y7. The intermediate water supply step may be executed after the finish of the continuous water supply step. Of course, the continuous water supply step and the intermediate water supply step may be alternately executed until one of the washing tubs reaches a predetermined water amount.

In the operation modes Y8 to Y10 and the operation modes Y18 to Y20, the water supply to the laundry treating device which was already in operation is continued, and simultaneously, the water supply to the laundry treating device which starts to operate will begin.

Hereinafter, a procedure for supplying cold water and hot water to the first or the second laundry treating devices will be described with reference to FIG. 5. The water supplied to each of the first and second laundry treating devices may be only cold water, only hot water, or both cold water and hot water simultaneously. That is, each water supply step may include separate hot water and cold water supply steps. For example, the water supply to the first laundry treating device may be executed by preferentially supplying hot water in a predetermined hot water amount, and subsequently supplying cold water in a predetermined cold water amount. Also, the hot water supply step and the cold water supply step may be alternately executed until the temperature of water in a washing tub reaches a predetermined temperature. Alternatively, the hot water supply step and the cold water supply step may be simultaneously executed until the temperature of water in the first or second washing tub reaches a predetermined temperature.

The table of FIG. 5 shows procedures for supplying cold water and hot water as part of one of the water supplying steps illustrated in FIGS. 3 and 4. More specifically, each of the water supply steps M, S, $S_i$, $M_i$, $S_i$, $M_{if}$, $S_{if}$, $M_f$, and $S_f$ may be executed by a method according to one of the operation modes Z1 to Z17 shown in FIG. 5. In FIG. 5, the subscript "i" represents the initiation of a supply of the associated temperature water and then the stopping of the supply before it is finished. The subscript "f" represents the resumption and finish of the supply of the associated temperature water. The subscript "if" represents supplying of the associated temperature water continuously from the initiation thereof to the finish thereof. A step without any subscript represents resuming the supply of the associated temperature water, and stopping the supply before it is finished.

In the operation mode Z1, the step of initiating the water supply to the first washing tub, namely, step $M_i$, may include an action $H_{if}$ for initiating the supply of hot water and continuing the supply of hot water until a sufficient amount is supplied, then stopping the supply of hot water. This step would also include an action $C_{if}$ for initiating the supply of cold water after the finish of the hot water supply, and continuing the supply of cold water until the cold water supply is finished. Note, step $M_i$ means that the supply of water to the first washing tub will be initiated, but not finished. Thus, the actions $H_{if}$ and $C_{if}$ in operation mode Z1 would only involve supplying a portion of the total water that will ultimately be supplied to the first washing tub.

In the operation mode Z2, the same step of $M_i$ may include an action $H_i$ for initiating the supply of hot water, and then stopping the supply of hot water. Subsequently, initiating the supply of cold water and continuing to supply the cold water until the cold water supply is finished Cif. Then resuming the supply of hot water, to finish the hot water supply $H_f$.

In the operation mode Z3, the step $M_i$ may include an action $H_i$ for initiating the supply of hot water and then stopping the hot water supply, an action $C_i$ for initiating the supply of cold water and then stopping the cold water supply, an action $H_f$ for resuming the supply of hot water and continuing the hot water supply until it is finished, and an action $C_f$ for again supplying cold water to finish the cold water supply.

In the operation mode Z4, step $M_i$ may include an action $H_i$ for initiating the supply of hot water and then stopping the hot water supply, an action $C_i$ for initiating the supply of cold water and then stopping the cold water supply, an action H for again supplying hot water, but stopping before the hot water supply is finished, an action $C_f$ for again supplying cold water to finish the cold water supply, and an action $H_f$ for again supplying hot water to finish the hot water supply.

In the operation mode Z5, step $M_i$ may include an action $H_i$ for initiating the supply of hot water, an action $C_i \cdot H_f$ for initiating the supply of cold water while continuing the hot water supply until it is finished, and an action $C_f$ for continuing the supply of cold water until it is finished.

In the operation mode Z6, step $M_i$ may include an action $H_i$ for initiating the supply of hot water, an action $C_i$ for initiating the supply of cold water, and an action $H_f \cdot C_f$ for simultaneously executing the hot water supply and the cold water supply, to finish the hot water supply and the cold water supply.

In the operation mode Z7, step $M_i$ may include an action $H_i$ for initiating the supply of hot water, and an action $C_{if} \cdot H_f$ for simultaneously supplying cold water and hot water such that the cold water supply and the hot water supply are simultaneously finished.

In the operation modes Z8 to Z14, step $M_i$ may include an action for preferentially supplying cold water. The operation modes Z8 to Z14 are reverse to the operation modes Z1 to Z7 in terms of the supply order of hot water and cold water, namely, the order of H and C.

On the other hand, in the operation mode Z15, step $M_i$ may include an action $H_i \cdot C_i$ for simultaneously initiating the hot water supply and the cold water supply, and an action $H_f \cdot C_f$ for simultaneously finishing the hot water supply and the cold water supply.

In the operation mode Z16, step $M_i$ may include an action $H_i \cdot C_i$ for simultaneously initiating the hot water supply and the cold water supply, an action $H \cdot C_f$ for continuing both supplies until the cold water supply is finished, and an action $H_f$ for continuing to supply hot water to finish the hot water supply.

In the operation mode Z17, step $M_i$ may include an action $H_i \cdot C_i$ for simultaneously initiating the hot water supply and the cold water supply, and an action $H_f \cdot C$ for preferentially finishing the hot water supply, and an action $C_f$ for continuing to supply cold water to finish the cold water supply.

Although the laundry treating device control methods have been described in conjunction with procedures for supplying water to two laundry treating devices, other embodiments may cover control methods for supplying water to more than three laundry treating devices.

Figure 6:
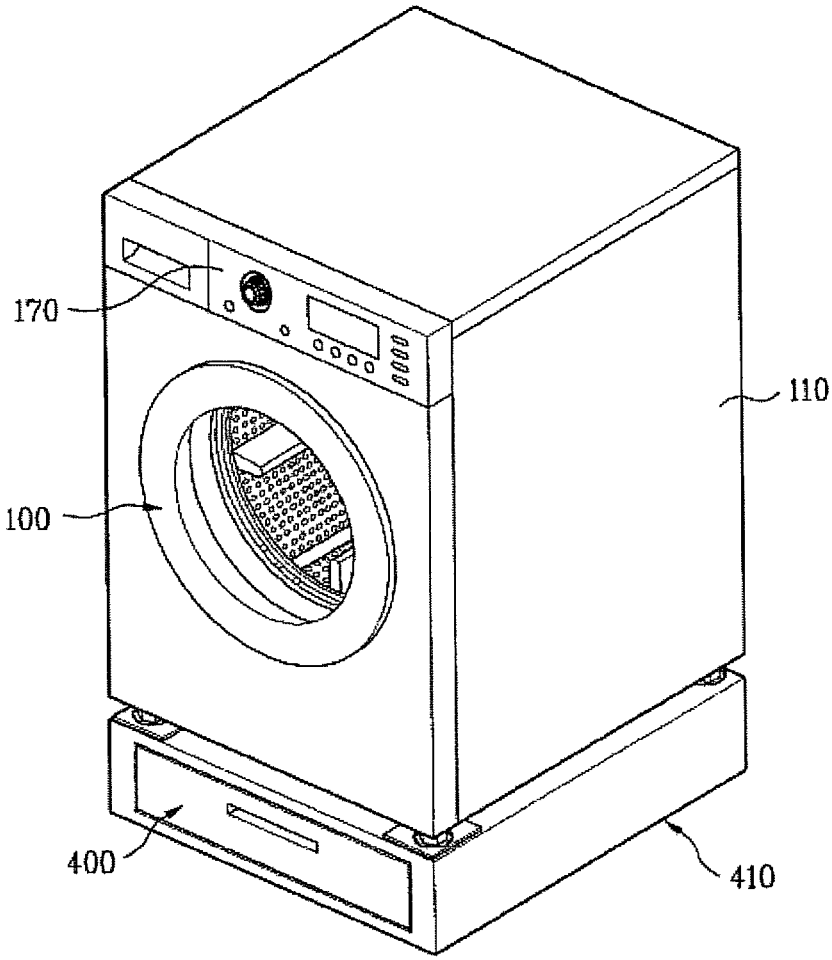
FIG. 6 is a table illustrating another embodiment of a laundry treating device.

FIG. 6 illustrates another embodiment of a laundry treating device. In the laundry treating device according to this embodiment, the first laundry treating device 100 is installed in the cabinet 110, namely, a first cabinet, whereas the second laundry treating device, which is designated by reference numeral 400 in FIG. 6, is installed in a second cabinet 410 forming a space independent of the first cabinet 110. A control panel 170, which controls both the first and second laundry treating devices, may be arranged at the front side of the first cabinet 110. The water supplying steps discussed above could also be used in a device as shown in this second embodiment.

The laundry treating device and control method thereof according to the present invention provide the following effects.

First, there is an advantage in that it is possible to simultaneously wash different kinds of laundry required to be independently washed, by simultaneously operating the first and second laundry treating devices, which operate independently.

Second, there is an advantage in that it is possible to secure cleanliness while reducing the consumption of electricity by selectively using different laundry treating devices in accordance with the amount and kind of laundry.

Third, there is an advantage in that it is possible to more effectively control the laundry treating devices by individually supplying water to the laundry treating devices in accordance with the laundry treating condition. For example, it is possible to simultaneously wash laundry in the first and second laundry treating devices, using hot water, by simultaneously supplying hot water to the first and second laundry treating devices through a single hot water supplier.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although numerous embodiments have been described, it should be understood that numerous other modifications and embodiments can be devised by those skilled in the art that will fall within the spirit and scope of the principles of this disclosure. More particularly, variations and modifications are possible in the component parts and/or arrangements which would fall within the scope of the disclosure, the drawings and the appended claims. In addition to variations and modifications in the component parts and/or arrangements, alternative uses will also be apparent to those skilled in the art.

What is claimed is:

1. A method of controlling a laundry treating apparatus comprising at least a first laundry treating device having a first washing tub into which laundry is loaded through a front side thereof and a second laundry treating device located below the first laundry treating device and having a drawer that is slideable forward with respect to the first laundry treating device, with a second washing tub provided in the drawer into which laundry, is loaded from an upper side of the drawer, a first heater to heat water supplied to the first washing tub and a second heater to heat water supplied to the second washing tub, the method comprising:

receiving operation information, at a controlling device which controls operation of the first and second laundry treating devices, to operate the first laundry treating device and the second laundry treating device positioned adjacent to the first laundry treating device; and;

supplying hot water to the first tub and to the second tub, concurrently or selectively, in accordance with the received operation information under control of the controlling device.

2. The method of claim 1, further comprising determining an order for performing a first water supplying step that supplies hot water to the first tub and a second water supplying step that supplies hot water to the second tub based on a predetermined algorithm, wherein the first water supplying step and the second water supplying step are operated selectively.

3. The method of claim 2, wherein one of the first water supplying step or the second water supplying step is operated after the other of the first water supplying step or the second water supplying step has finished.

4. The method of claim 2, wherein the first water supplying step and the second water supplying step are operated selectively and repeatedly until an amount of water in one of the first tub or the second tub is equal to a corresponding predetermined amount of water.

5. The method of claim 4, wherein a first time duration during which hot water is supplied to the first tub is different from a second time duration during which hot water is supplied to the second tub.

6. The method of claim 2, wherein at least one of the first water supplying step or the second water supplying step includes hot-water supply action and cold-water supply action respectively.

7. The method of claim 6, wherein the hot-water supply action and the cold-water supply action are operated selectively and repeatedly until a temperature of water in at least one of the first tub or the second tub is equal to a predetermined water temperature.

8. The method of claim 6, wherein the hot-water supply action and the cold-water supply action are operated concurrently until a temperature of water in at least one of the first tub or the second tub is equal to a corresponding predetermined water temperature.

9. The method of claim 1, wherein supplying hot water includes an intermediate hot water supplying step to supply hot water to a newly operating one of first or second laundry treating device after stopping supplying hot water to the other of the first or second laundry treating device which is currently operating.

10. The method of claim 9, wherein supplying hot water includes an additional hot water supplying step to supply hot water to the other of the first or second laundry treating device after the intermediate hot water supplying step has finished.

11. The method of claim 9, wherein the intermediate hot water supplying step and an additional hot water supplying step to supply hot water to a currently operating one of the first or second laundry treating device are performed selectively and repeatedly until an amount of water in one of the first tub or the second tub is equal to a corresponding predetermined amount of water.

12. The method of claim 1, wherein supplying hot water includes a successive hot water supplying step to supply hot water to a currently operating one of the first or second laundry treating device, and an intermediate hot water supplying step to supply hot water to the other of the first or second laundry treating device being newly operated.

13. The method of claim 12, wherein the intermediate hot water supplying step is performed after the successive hot water supplying step has finished.

14. The method of claim 12, wherein the successive hot water supplying step and the intermediate hot water supplying step are operated selectively and repeatedly until an amount of water in one of the first tub or the second tub is equal to a corresponding predetermined amount of water, or the successive hot water supplying step and the intermediate hot water supplying step are operated concurrently.

15. The method of claim 12, wherein at least one of the successive hot water supplying step or the intermediate hot water supplying step includes a hot-water supply action and cold-water supply action, wherein the hot-water supply action and the cold water supply action are operated concurrently or selectively and repeatedly.

* * * * *